US009228706B2

(12) United States Patent
Andersen

(10) Patent No.: US 9,228,706 B2
(45) Date of Patent: Jan. 5, 2016

(54) LIGHTING ARRAY PROVIDING VISUALLY-CAPTIVATING LIGHTING EFFECTS

(71) Applicant: Brent V. Andersen, Salt Lake City, UT (US)

(72) Inventor: Brent V. Andersen, Salt Lake City, UT (US)

( * ) Notice: Subject to any disclaimer, the term of this patent is extended or adjusted under 35 U.S.C. 154(b) by 73 days.

(21) Appl. No.: 14/260,147

(22) Filed: Apr. 23, 2014

(65) Prior Publication Data

US 2015/0308641 A1 Oct. 29, 2015

(51) Int. Cl.

| | |
|---|---|
| ***F21V 7/00*** | (2006.01) |
| ***F21S 4/00*** | (2006.01) |
| ***G09F 13/22*** | (2006.01) |
| *F21Y 101/02* | (2006.01) |

(52) U.S. Cl.

CPC . *F21S 4/002* (2013.01); *F21V 7/00* (2013.01); *G09F 13/22* (2013.01); *F21Y 2101/02* (2013.01); *G09F 2013/222* (2013.01)

(58) Field of Classification Search

CPC ..... F21V 7/00; F21V 2101/02; F21V 7/0083; F21V 7/0091; G09F 2013/222; G09F 13/22; F21S 4/00; F21S 10/005

See application file for complete search history.

(56) References Cited

U.S. PATENT DOCUMENTS

| | | | | |
|---|---|---|---|---|
| 4,254,453 | A | 3/1981 | Mouyard et al. | |
| 4,742,432 | A | 5/1988 | Thillays et al. | |
| 5,390,093 | A | 2/1995 | Himeno et al. | |
| 5,779,351 | A | 7/1998 | Erickson et al. | |
| 5,954,423 | A * | 9/1999 | Logan | F21V 5/00 362/235 |
| 6,318,886 | B1 | 11/2001 | Stopa et al. | |
| 6,502,964 | B1 * | 1/2003 | Simon | F21S 8/081 362/291 |
| 6,840,654 | B2 | 1/2005 | Guerrieri et al. | |
| 7,008,079 | B2 | 3/2006 | Smith | |
| 7,210,806 | B2 | 5/2007 | Holman | |
| 7,400,439 | B2 | 7/2008 | Holman | |
| 7,703,945 | B2 * | 4/2010 | Leung | F21K 9/50 257/98 |
| D636,926 | S | 4/2011 | You | |
| 8,097,894 | B2 | 1/2012 | Bierhuizen et al. | |
| 8,152,333 | B2 | 4/2012 | Boyer | |
| 8,297,786 | B2 * | 10/2012 | Shani | G02B 5/021 362/247 |
| 8,303,130 | B2 | 11/2012 | Sayers et al. | |
| 8,876,347 | B2 * | 11/2014 | Ruelle | B60Q 1/2611 362/559 |
| 2003/0063474 | A1 * | 4/2003 | Coushaine | F21K 9/00 362/517 |
| 2004/0105262 | A1 | 6/2004 | Tseng et al. | |

(Continued)

OTHER PUBLICATIONS

Marc, "Video: Audi Developing Artifical Audi R8 E-tron Sound Track—E-sound," Apr. 7, 2012, last available at http://www.gtspirit.com/2012/04/07/video-audi-developing-artifical-audi-r8-e-tron-sound-track-e-sound/.

(Continued)

*Primary Examiner* — Anh Mai
*Assistant Examiner* — Fatima Farokhrooz
(74) *Attorney, Agent, or Firm* — Nelson and Nelson; Daniel P. Nelson; Alexis V. Nelson

(57) ABSTRACT

An apparatus is disclosed in one embodiment of the invention as including an array of lighting modules organized in an alternating grid-like pattern. Each lighting module includes a pair of opposing light-emitting sides and a pair of opposing light-obstructing (e.g., light-reflecting) sides. Each lighting module in the grid-like pattern is mounted transversely to the lighting modules that are adjacent to it. As a result, each lighting module in the array illuminates the light-obstructing sides of lighting modules that are adjacent to its light-emitting sides.

20 Claims, 8 Drawing Sheets

(56) References Cited

U.S. PATENT DOCUMENTS

2005/0286251 A1* 12/2005 Smith ..... F21S 4/008 362/327
2006/0176702 A1* 8/2006 Shen ..... B60Q 1/2611 362/295
2006/0268555 A1* 11/2006 Kelly ..... F21K 9/137 326/341
2007/0139798 A1* 6/2007 Epstein ..... F21V 5/02 359/831
2007/0297179 A1* 12/2007 Leung ..... F21K 9/50 362/296.07
2011/0163670 A1* 7/2011 Ruelle ..... B60Q 1/2611 315/77
2015/0036128 A1* 2/2015 Chen ..... G01N 21/6489 356/237.5

OTHER PUBLICATIONS

Wikipedia, "Rundle Street, Adelaide; Rundle Lantern," page last modified on Dec. 31, 2013, last available at http://en.wikipedia.org/wiki/Rundle_Street,_Adelaide.

* cited by examiner

LIGHTING ARRAY PROVIDING VISUALLY-CAPTIVATING LIGHTING EFFECTS

BACKGROUND

1. Field of the Invention

This invention relates to apparatus and methods for providing visually captivating lighting effects.

2. Background of the Invention

Signage and other visual elements are used extensively in today's world to convey information, provide entertainment, and/or establish a particular mood or ambiance. As technology has improved, so has the sophistication of signage and other visual elements. For example, improvements in areas such as light generation (e.g., LEDs as opposed to incandescent bulbs) and lighting controls have enabled significant advances in signage and other visual elements. Signage displaying static content has given way to or been enhanced by more advanced signage capable of displaying moving images and/or other dynamic or changing content. This is evident in the billboard industry where conventional static billboards have given way to electronic billboards capable of displaying myriad types of static and/or dynamic content.

In some cases, lighting elements such as flashing lights, colored lights, color-changing lights, cove lighting, indirect lighting, or the like may be used to create special lighting effects to capture an audiences' attention and thereby captivate, entertain, or convey information. Coves or other structures or shapes may be used in conjunction with lighting to create an extensive range of lighting effects to capture the attention or to create a particular mood or atmosphere. Used correctly, lighting and other visual elements may be used to heighten a sense of drama in a particular space or structure or make a space or structure feel brighter or more inviting. Lighting may also be used to enhance or highlight particular details of buildings, landscapes, or other structures.

As with most fields of endeavor, improvements or variations are constantly sought after by those of skill in the art. For example, new types of signage, visual elements, or lighting effects are desired to captivate, entertain, convey information, establish mood or ambiance, or provide a desired experience.

SUMMARY

The invention has been developed in response to the present state of the art and, in particular, in response to the problems and needs in the art that have not yet been fully solved by currently available apparatus and methods. Accordingly, apparatus and methods in accordance with the invention have been developed to provide visually captivating lighting effects. The features and advantages of the invention will become more fully apparent from the following description and appended claims, or may be learned by practice of the invention as set forth hereinafter.

Consistent with the foregoing, an apparatus is disclosed in one embodiment of the invention as including an array of lighting modules organized in an alternating grid-like pattern. Each lighting module includes a pair of opposing light-emitting sides and a pair of opposing light-obstructing (e.g., light-reflecting) sides. Each lighting module in the grid-like pattern is mounted transversely to the lighting modules that are adjacent to it. As a result, each lighting module in the array illuminates the light-obstructing sides of lighting modules that are adjacent to its light-emitting sides.

In another embodiment, an apparatus in accordance with the invention includes an array of lighting modules organized in an alternating grid-like pattern. Each lighting module includes a tent-like structure that emits light from ends thereof, while reflecting light from sides thereof. Each lighting module in the grid-like pattern is mounted transversely to the lighting modules that are adjacent to it. As a result, each lighting module in the array illuminates sides of the lighting modules that are adjacent to its light-emitting ends.

BRIEF DESCRIPTION OF THE DRAWINGS

In order that the advantages of the invention will be readily understood, a more particular description of the invention briefly described above will be rendered by reference to specific embodiments illustrated in the appended drawings. Understanding that these drawings depict only typical embodiments of the invention and are not therefore to be considered limiting of its scope, the invention will be described and explained with additional specificity and detail through use of the accompanying drawings, in which.

DETAILED DESCRIPTION

It will be readily understood that the components of the present invention, as generally described and illustrated in the Figures herein, could be arranged and designed in a wide variety of different configurations. Thus, the following more detailed description of the embodiments of the invention, as represented in the Figures, is not intended to limit the scope of the invention, as claimed, but is merely representative of certain examples of presently contemplated embodiments in accordance with the invention. The presently described embodiments will be best understood by reference to the drawings, wherein like parts are designated by like numerals throughout.

Figure 1:
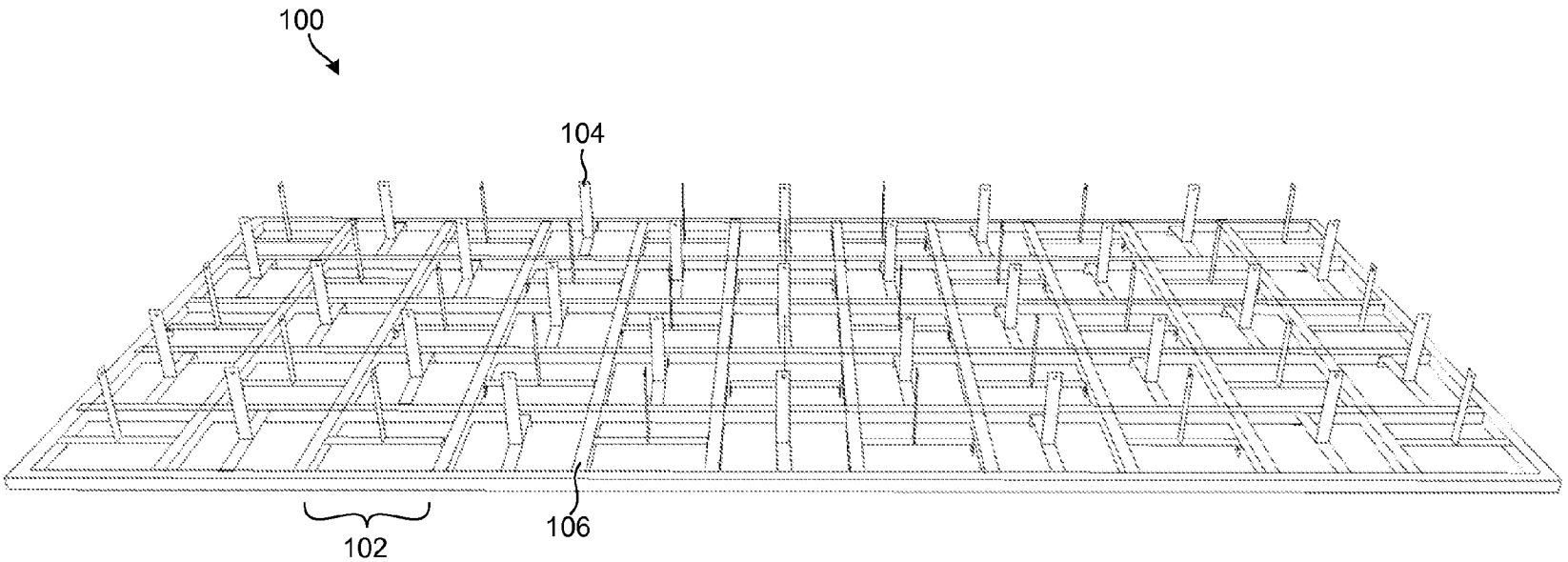
FIG. 1 is a perspective view of one embodiment of a frame for supporting various lighting modules to provide a lighting array in accordance with the invention.

Referring to FIG. 1, a perspective view of one embodiment of a frame 100 for supporting various lighting modules in accordance with the invention is illustrated. As shown, the frame 100 forms a grid, with each square 102 of the grid configured to support a lighting module. In the illustrated embodiment, each square of the grid includes a bracket 104 configured to retain a lighting element (not shown) such as an LED. In certain embodiments, the lighting element may be located at or near a center of a lighting module to provide a desired dispersion or emanation of light from the lighting module. As can also be observed in FIG. 1, each bracket 104 is mounted transversely to the brackets 104 adjacent to it. This is due to the fact that the lighting modules are mounted transversely to one another, as will be explained in more detail hereafter.

The frame 100 may be constructed from any suitable material having sufficient rigidity and strength, such as aluminum, aluminum alloy, steel, or various plastics. The frame members 106 may be welded together or held together with fasteners such as screws, rivets, or the like. The frame members 106 may be square tubing but could also be open channel or angled members. As shown, the frame members 106 may provide a flat surface onto which to mount the lighting modules. The frame 100 is provided by way of example and is not intended to be limiting. Other methods or techniques for constructing a frame 100 are possible and within the scope of the invention.

Figure 2:
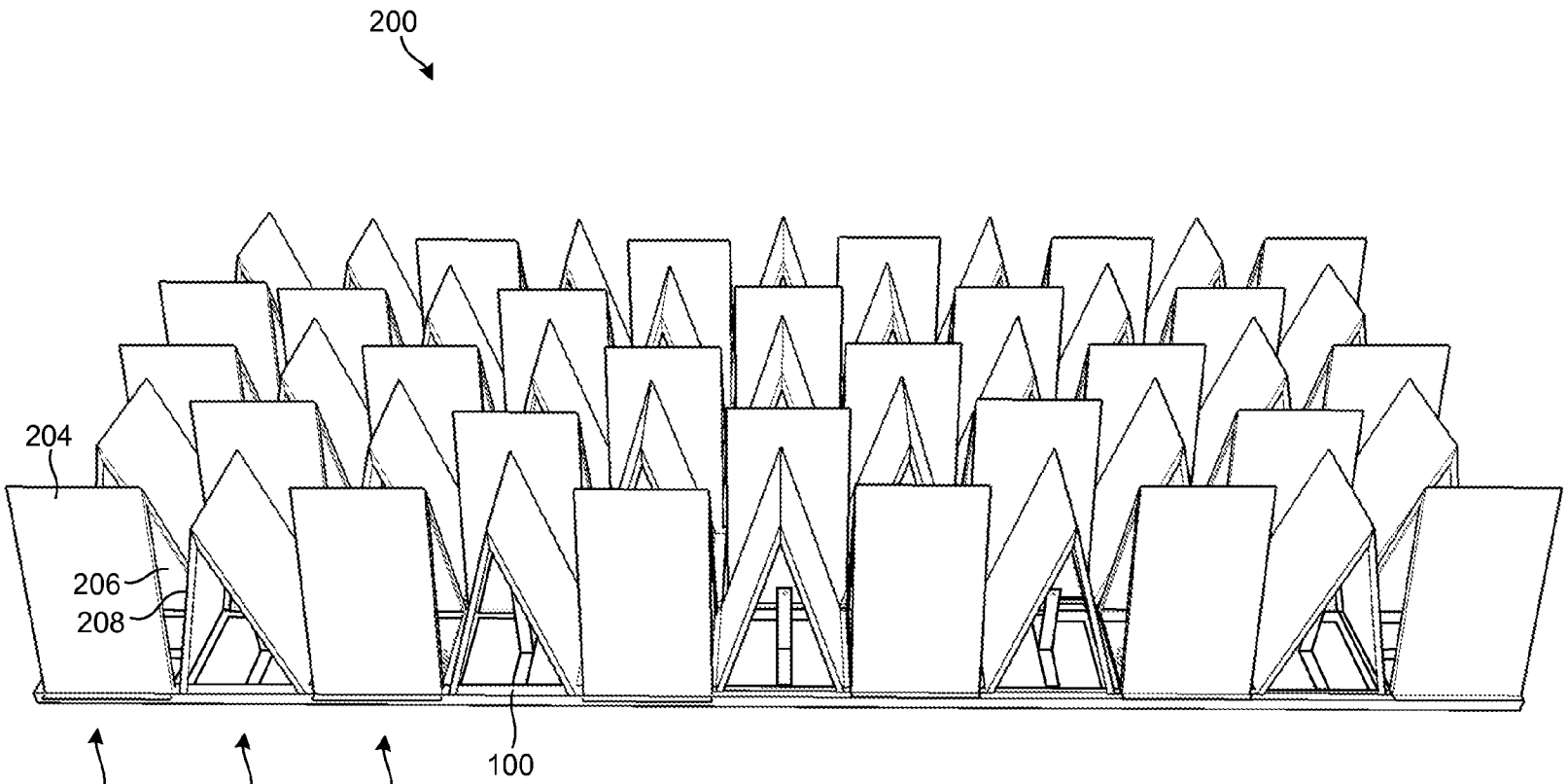
FIG. 2 is a perspective view of one embodiment of an array (or sub-array or panel) of lighting modules in accordance with the invention.

Referring to FIG. 2, a perspective view of one embodiment of an array 200 (or sub-array or panel) of lighting modules 202 in accordance with the invention is illustrated. As shown, each lighting module 202 includes a tent-like structure, attached to the frame 100 by screws, rivets, welding, or other means, that acts as a shroud 204 or covering 204 for the lighting module 202. The tent-like structure may also provide an architectural element to the array 200 that adds visual interest thereto. In addition, when the tent-like structures are fabricated from a reflective or semi-reflective material such as aluminum or alloys thereof, the tent-like structures may provide reflective properties to the array 200 that are evident to observers not only when the array 200 is lit, but also under natural lighting conditions such as sunlight. The inventor of the disclosed invention has found that the illustrated tent-like structures provide unexpected visual and reflective qualities to the array 200 that may not be present with other shapes or structures. For example, using the tent-like structures, certain patterns may be visible in the array 200 depending on the angle from which the array 200 is viewed, and depending on the angle and/or intensity of natural or generated light directed onto the array 200.

As shown, the lighting modules 202 are mounted transversely to adjacent lighting modules 202. That is, each lighting module 202 is rotated ninety degree relative to the lighting modules 202 that are adjacent to it. This provides an interesting lighting effect, which will be explained in more detail in association with FIG. 4. In general, mounting the lighting modules 202 in the disclosed manner causes a lighting module 202 to illuminate lighting modules 202 which are adjacent to its light-emitting ends 206 or sides 206. In other words, light emitted from a lighting module 202 is most visible or evident on lighting modules 202 that are adjacent to its light-emitting ends 206 or sides 206. If the lighting modules 202 are thought of as creating "pixels" of light in an overall array 200, then the pixels for each lighting module 202 are apparent on the sides 208 of the lighting modules 202 adjacent to its light-emitting ends 206 or sides 206.

Figure 3:
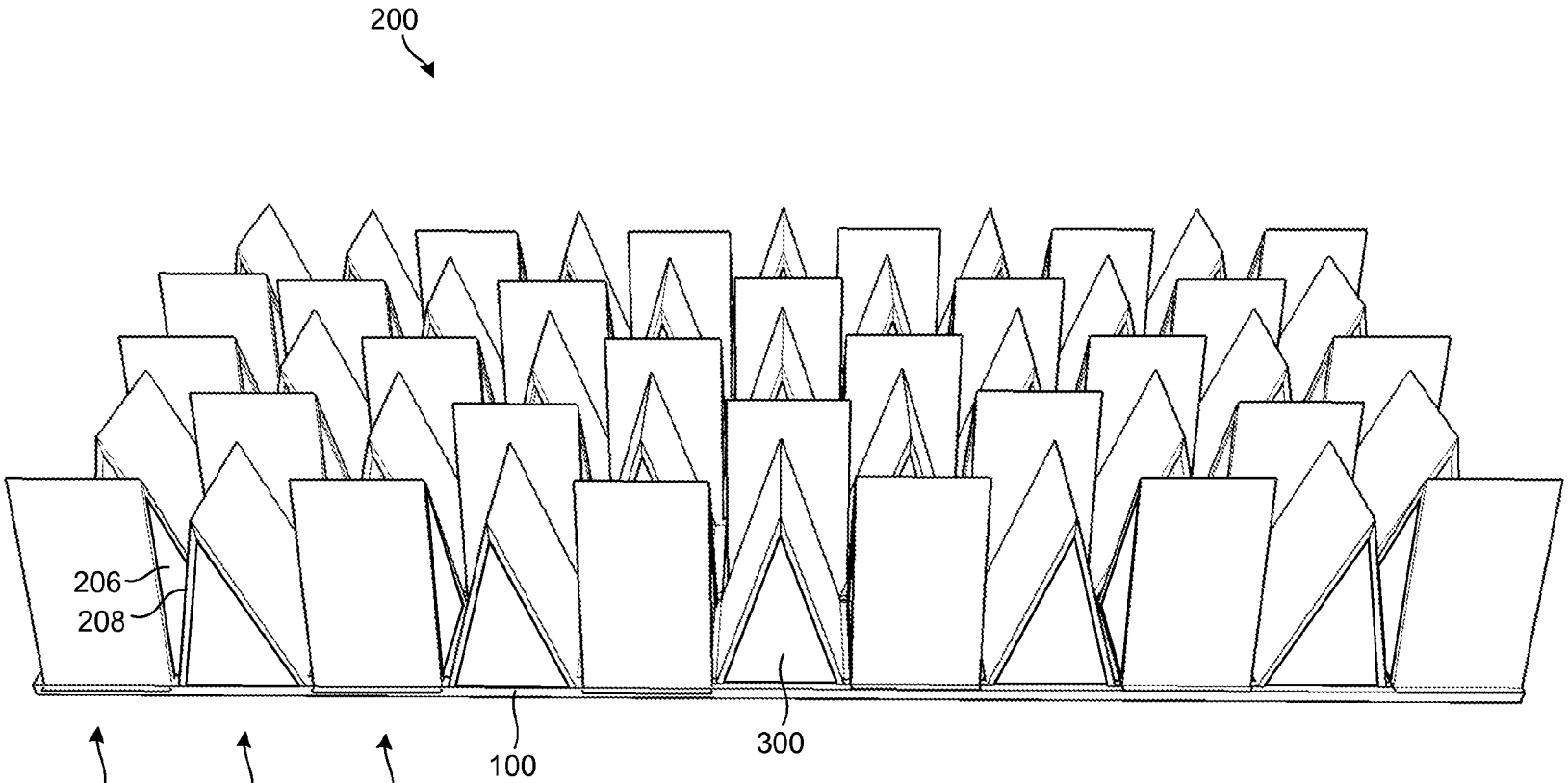
FIG. 3 is a perspective view of the array of FIG. 2, except that each lighting module includes a translucent or transparent material covering its light-emitting ends or sides.

Referring to FIG. 3, in certain embodiments, the ends of each lighting module 202 are covered with a transparent or translucent material 300, such as sign-grade acrylic glass or a similar material. A translucent material 300 may be selected to allow light to emanate from the lighting modules 202 onto adjacent lighting modules 202, while substantially hiding from view components (e.g., LEDs, brackets, etc.) within the lighting modules 202. FIG. 3 is a perspective view of the same array 200 as FIG. 2, except that each lighting module 202 includes a translucent or transparent material 300 covering its light-emitting sides 206 or ends 206. The translucent or transparent covering 300 may not only hide internal components from view, but also protect internal components from weather or other elements.

An array 200 in accordance with the invention may be used by itself, or the array 200 may be a sub-module or panel that is assembled into a larger array. For example, a plurality of panels 200 may be placed adjacent to one another on a wall or structure to provide a much larger array. This modular approach may facilitate assembly and serviceability. For example, panels 200 may be pre-assembled on the ground and installed in a modular fashion on a wall or building to create a much larger array. Similarly, instead of removing, replacing, or servicing an entire array, panels 200 or individual lighting modules 202 on a panel 200 may be removed, replaced, or serviced without disturbing other panels 200 or lighting modules 202. Thus, array panels 200 and lighting modules 202 may be designed in a way that facilitates installation, removal, and servicing.

In certain embodiments, wiring may be provided to each array 200 individually or the arrays 200 may be daisy-chained together in order to enable control of the lighting elements 504 contained therein. In certain embodiments, the lighting elements 504 in each lighting module 202 are individually addressable to enable a large number of lighting elements 504 to be controlled using a relatively small number of control wires. For, example, the lighting modules 202 may include individually addressable RGB LEDs 504, where each RGB LED 504 contains a small controller chip that recognizes control signals addressed to it, and displays desired colors and/or color intensities in accordance with the received control signals.

In addition to providing lighting effects, the unique design of the array 200 and lighting modules 202 may also provide a sound-dampening effect. For example, the triangular shape of the lighting modules 202 and the transverse mounting of the lighting modules 202 relative to one another may deflect and scatter sound waves that are incident on the array 200, as opposed to reflecting the sound waves back toward a listener. Thus, the array 200 may significantly deaden sound and noise. The inventor of the disclosed invention has noticed significant sound-dampening effects with respect to freeway noise when the array 200 is mounted on a wall or building close to a freeway. In certain embodiments, other sound-dampening or sound-absorbing elements, such as sound-dampening foams or boards, may be incorporated into the lighting modules 202 to provide additional sound-dampening qualities.

The array 200 may be used for a wide variety of applications and is not limited to any single application. In certain embodiments, the array 200 may be used as a dynamic building skin to display static or moving images and/or provide lighting effects to captivate or draw the interest of an audience. The array 200 may also be used as a backdrop for a stage, for signs such as large marquee signs or billboards, or as architectural elements to draw interest to structures, monuments, or landscapes. The array may also be used for seasonal displays or events where lighting is needed, or provide props for lighting shows or performances. A wide variety of different applications or uses are within the scope of the invention.

Figure 4:
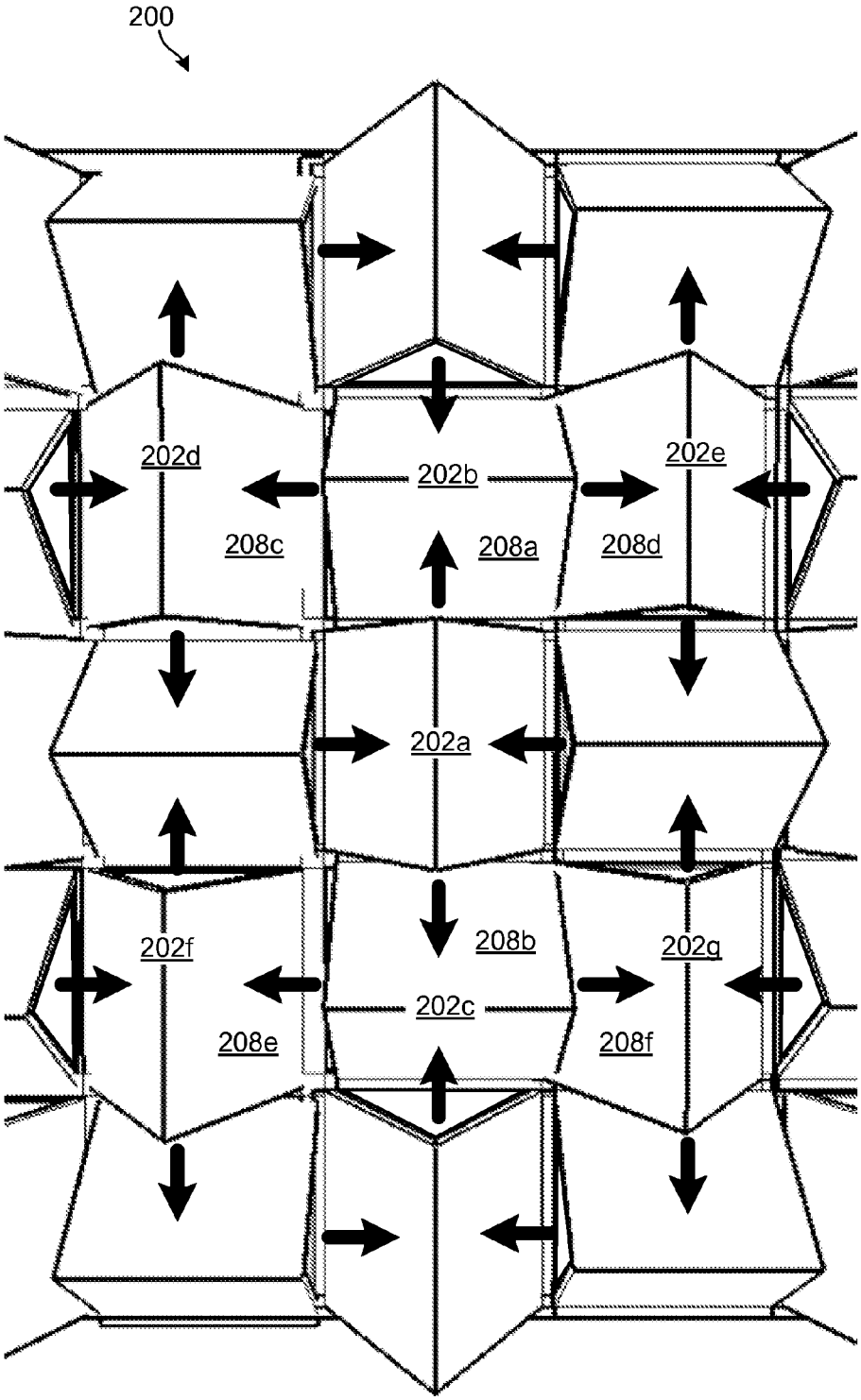
FIG. 4 is a top view of the array showing how light emitted from each lighting module is used to illuminate adjacent lighting modules.

Referring to FIG. 4, a top view of the array 200 is illustrated that shows how light emitted from each lighting module 202 is used to illuminate adjacent lighting modules 202. As mentioned above, mounting the lighting modules 202 transversely to adjacent lighting modules 202 causes a lighting module 202 to illuminate lighting modules 202 which are adjacent to its light-emitting ends 206 or sides 206. The arrows in FIG. 4 show the approximate directions that light is emanated in the array 200, as well as the surfaces onto which the light is directed. For example, lighting module 202*a* will emanate light onto sides 208*a*, 208*b* of adjacent lighting modules 202*b*, 202*c*; lighting module 202*b* will emanate light onto sides 208*c*, 208*d* of adjacent lighting modules 202*d*, 202*e*; and lighting module 202*c* will emanate light onto sides 208*e*, 208*f* of adjacent lighting modules 202*f*, 202*g*. Each side 208 of each lighting module 202 will create a "pixel" in the overall array 200. By varying the color and intensity of light emanated from the lighting modules 202, and thus the color and intensity of each pixel, a desired image or lighting effect may be generated on the array 200.

It is worth noting that each lighting module 202 may be configured to direct light of a different color and/or intensity from each end 206 of the lighting module 202. That is, each lighting module 202 may have a separate lighting element 504 for each end 206 of the lighting module 202. Thus, referring again to FIG. 4, a lighting module 202*a* may include a first lighting element 504 to direct light having a first color and/or intensity onto a side 208*a*, and a second lighting element 504 to direct light having a second color and/or intensity onto a side 208*b*. In other embodiments, each lighting module 202 may direct light of the same color and/or intensity from both ends of the lighting module 202.

Figure 5:
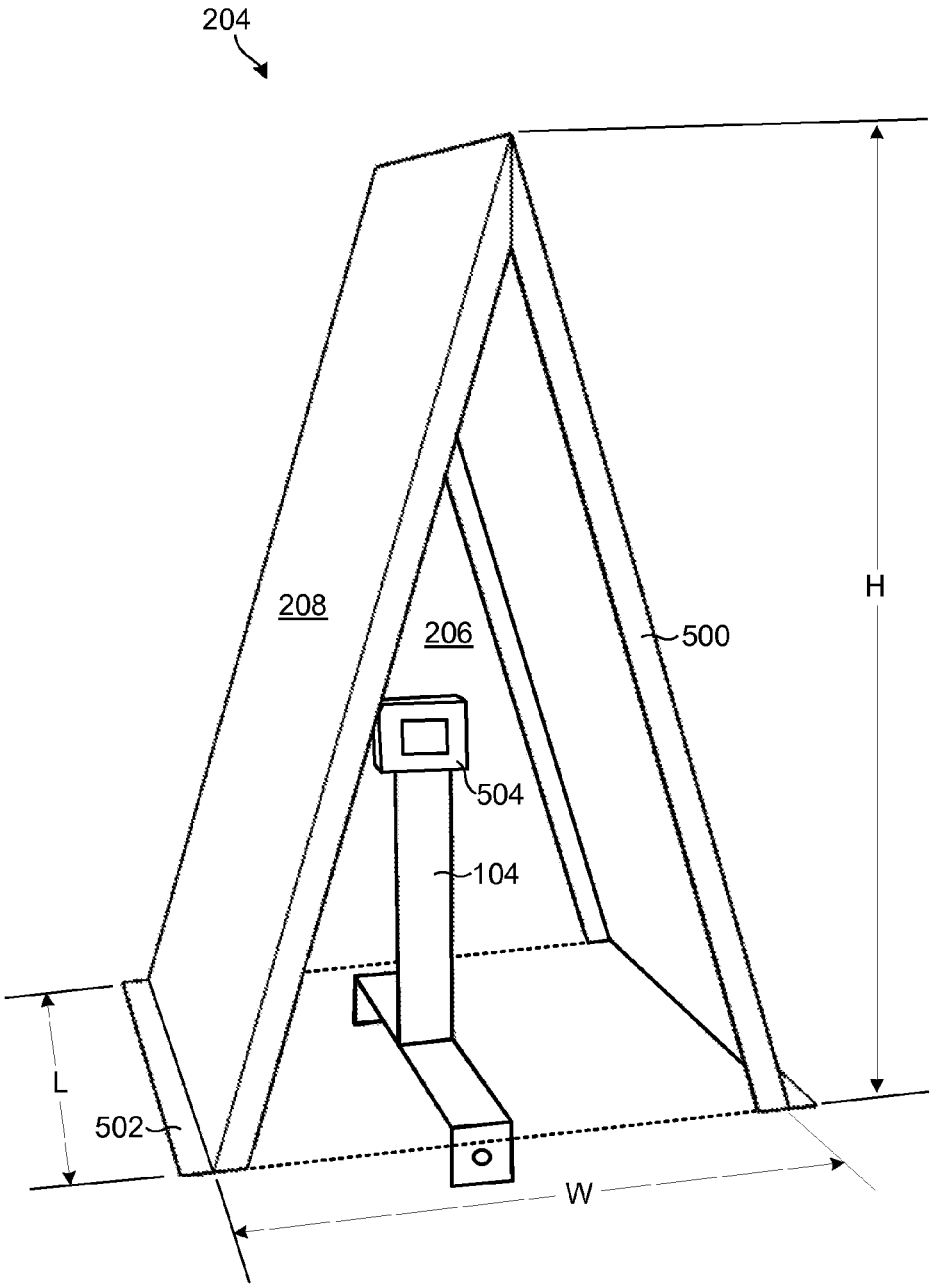
FIG. 5 is a perspective view of one embodiment of a tent-like structure that may be used with a lighting module in accordance with the invention.

Referring to FIG. 5, as previously mentioned, in certain embodiments, each lighting module 202 may include a tent-like structure that acts as a shroud 204 or covering 204 for the lighting module 202. A bracket 104 (attached to a frame 100) may hold a lighting element 504 (such as an LED or incandescent light) inside the tent-like structure, such as at or near a center of the structure. In certain embodiments, the bracket 104 holds two separate lighting elements 504; a first lighting element 504 for emitting light from a first end of the tent-like structure; and second lighting element 504 for emitting light from a second end of the tent-like structure.

In addition to providing a shroud 204 for the lighting module 202, the exterior of the tent-like structure also provides a canvas or reflective element for light emanated from neighboring lighting modules 202. In certain embodiments, the pitch of the tent-like structure may be adjusted to provide a desired lighting effect. For example, in certain embodiments, a width (W) of the tent-like structure is substantially the same as a length (L) of the tent-like structure (giving the lighting module 202 a substantially square footprint), while a height (H) of the tent-like structure may be substantially larger than the width (W) or length (L). In certain embodiments, the height (H) is 1.1 to 2.5 times larger then the width (W) or length (L). In other embodiments, the height (H) is related to the width (W) or length (L) by the golden ratio. For example, in certain embodiments, the height (H) of the tent-like structure is about 1.618 (the golden ratio) times the width (W) or length (L) of the tent-like structure. The inventor of the disclosed invention has found that lighting modules 202 with dimensions in accordance with the golden ratio are visually attractive and lend themselves well to providing the lighting effects described herein.

Figure 6:
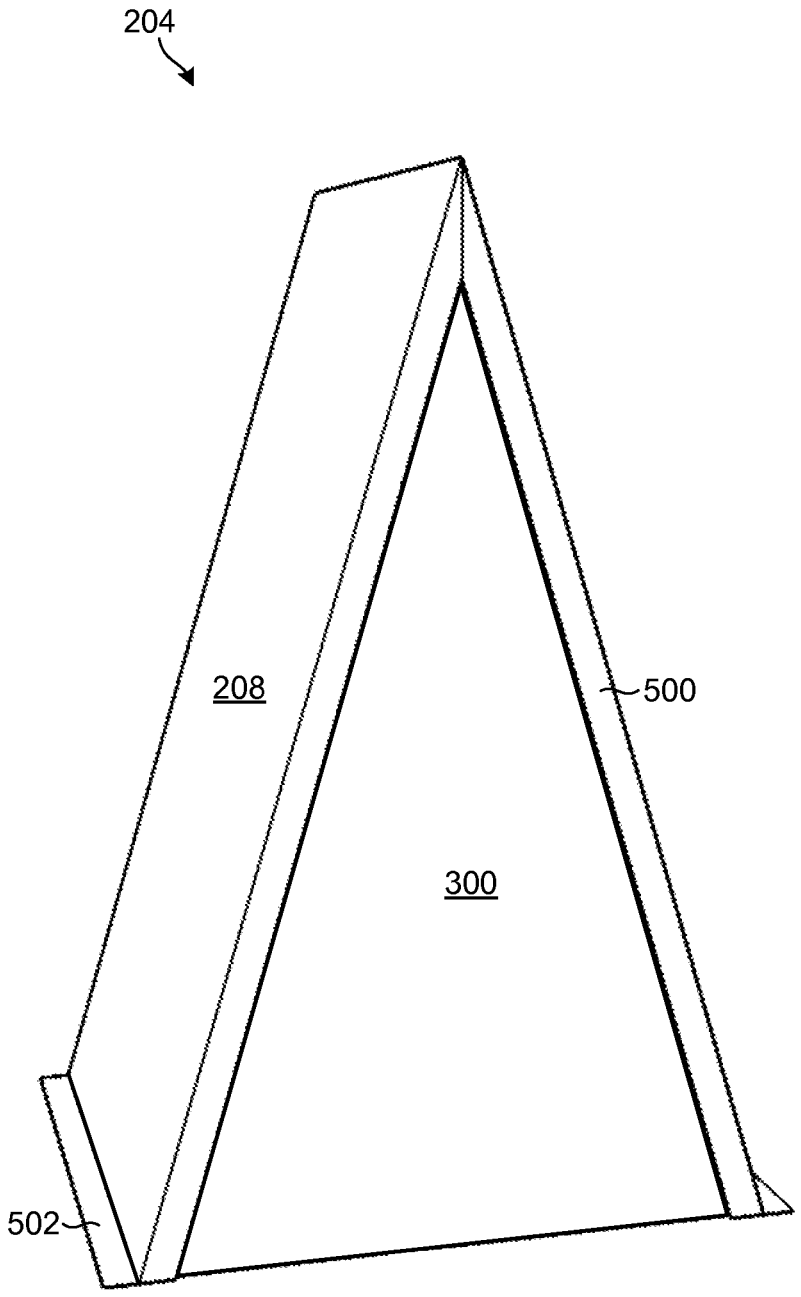
FIG. 6 is a perspective view of a lighting module comprising a tent-like structure and a transparent or translucent material covering the light-emitting sides or ends of the tent-like structure.

In certain embodiments, the tent-like structure is fabricated such that it may be cut, stamped, or bent from a sheet-like material, such as aluminum sheet metal. This may reduce the manufacturing costs of the tent-like structure and make large arrays 200 of the lighting modules 202 more economically feasible. As shown in FIG. 5, in certain embodiments, the tent-like structure may include a lip 500 or flange 500 on each end of the tent-like structure. The translucent or transparent material 300 (e.g., sign-grade acrylic glass or similar material) previously discussed may rest against or be mounted to this lip 500 or flange 500, such as to the inside of the lip 500 or flange 500. FIG. 6 shows the tent-like structure with the translucent or transparent material 300 in place. In certain embodiments, the tent-like structure may also include a lip 502 or flange 502 extending from a base of the tent-like structure. This lip 502 or flange 502 may allow the tent-like structure to be mounted to a frame 100 with fasteners or welds, as previously discussed.

Figure 7:
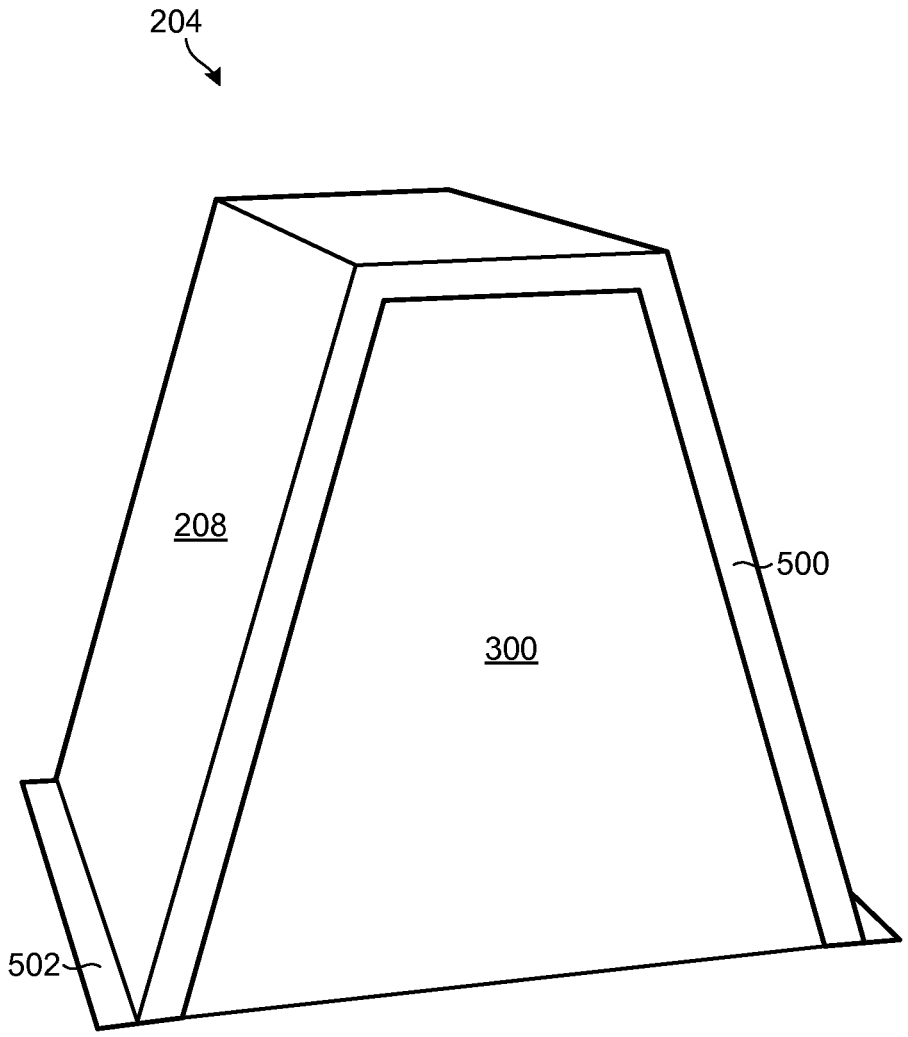
FIG. 7 shows an alternative embodiment of a lighting module in accordance with the invention.
Figure 8:
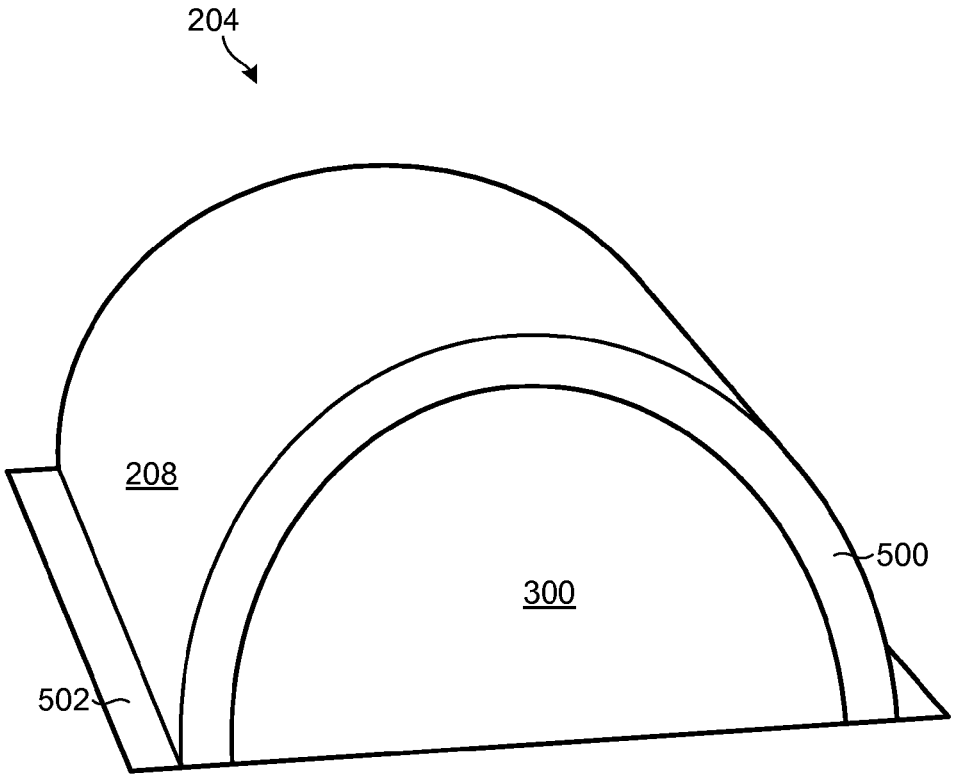
FIG. 8 shows another alternative embodiment of a lighting module in accordance with the invention.

Referring to FIGS. 7 and 8, although particular emphasis has been directed herein to shrouds 204 having a tent-like shape, other open-ended shrouds 204 or coverings 204 are possible and within the scope of the invention. Several non-limiting examples are illustrated in FIGS. 7 and 8. FIG. 7 shows an open-ended shroud 204 having a trapezoidal prism shape. In such an embodiment, light may emanate through a transparent or translucent material 300 at ends of the shroud 204, while light from neighboring lighting modules 202 may be directed onto sides 208 of the shroud 204.

FIG. 8 shows an open-ended shroud 204 having a half cylinder shape. In such an embodiment, light may emanate through a transparent or translucent material 300 at ends of the shroud 204, while light from neighboring lighting modules 202 may be incident on sides 208 of the shroud 204. One notable difference between the shroud 204 illustrated in FIG. 8 and those illustrated in FIGS. 6 and 7 is the light-diffusing characteristics of the shroud 204. Light that is incident on the sides 208 of the shroud 204 will be diffused or reflected more widely due to its curved exterior surface. This may provide a different lighting effect than a shroud 204 that has substantially planar sides, like the shrouds 204 of FIGS. 6 and 7.

The apparatus and methods disclosed herein may be embodied in other specific forms without departing from their spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The invention claimed is:

1. An apparatus comprising:

an array of lighting modules organized in an alternating grid-like pattern, each lighting module comprising a pair of opposing light-emitting sides and a pair of opposing light-obstructing sides, wherein each lighting module in the grid-like pattern is mounted transversely to adjacent lighting modules.

2. The apparatus of claim 1, wherein each pair of light-obstructing sides form an open-ended shroud containing at least one lighting element.

3. The apparatus of claim 2, wherein the open-ended shroud is a tent-like structure.

4. The apparatus of claim 2, wherein the open-ended shroud has one of a half cylinder shape and a triangular prism shape.

5. The apparatus of claim 2, wherein the at least one lighting element comprises at least one individually addressable LED.

6. The apparatus of claim 1, wherein the light-obstructing sides are light-reflective.

7. The apparatus of claim 1, wherein the light-obstructing sides are fabricated from aluminum or alloys thereof.

8. The apparatus of claim 1, wherein each lighting module comprises a substantially square footprint.

9. The apparatus of claim 1, wherein a height of the lighting module is larger than a width or length of the lighting module.

10. The apparatus of claim 1, wherein each lighting module illuminates lighting modules adjacent to its light-emitting sides.

11. The apparatus of claim 2, wherein the at least one lighting element comprises a first lighting element directing light toward a first side of the pair of light-emitting sides, and a second lighting element directing light toward a second side of the pair of light-emitting sides.

12. The apparatus of claim 1, wherein the light-emitting sides are covered with one of a translucent and a transparent material.

13. The apparatus of claim 1, wherein the array is made up of a plurality of rectangular panels, each rectangular panel comprising a plurality of lighting modules.

14. An apparatus comprising:

an array of lighting modules organized in an alternating grid-like pattern, each lighting module comprising a tent-like structure that emits light from ends of the tent-like structure, while reflecting light from sides of the tent-like structure, wherein each lighting module in the grid-like pattern is mounted transversely to adjacent lighting modules.

15. The apparatus of claim 14, wherein the sides of the tent-like structure are fabricated from aluminum or alloys thereof.

16. The apparatus of claim 14, wherein a height of the tent-like structure is larger than a width or length of the tent-like structure.

17. The apparatus of claim 14, wherein a base of the tent-like structure has a substantially square footprint.

18. The apparatus of claim 14, wherein the ends of the tent-like structure are covered with one of a translucent and a transparent material.

19. The apparatus of claim 14, further comprising a first lighting element within the tent-like structure that emits light through a first end of the tent-like structure, and a second lighting element within the tent-like structure that emits light through a second end of the tent-like structure.

20. The apparatus of claim 19, wherein the first and second lighting elements are individually addressable LEDs.

* * * * *